US007037093B2

(12) United States Patent
Jong

(10) Patent No.: US 7,037,093 B2
(45) Date of Patent: May 2, 2006

(54) DIVIDING DEVICE

(75) Inventor: Pieter De Jong, 'T Harde (NL)

(73) Assignee: De Jong Engineering Elburg B.V., Elburg (NL)

( * ) Notice: Subject to any disclaimer, the term of this patent is extended or adjusted under 35 U.S.C. 154(b) by 0 days.

(21) Appl. No.: 10/475,947

(22) PCT Filed: Feb. 6, 2002

(86) PCT No.: PCT/NL02/00085

§ 371 (c)(1),
(2), (4) Date: Oct. 27, 2003

(87) PCT Pub. No.: WO02/062459

PCT Pub. Date: Aug. 15, 2002

(65) Prior Publication Data

US 2004/0140322 A1 Jul. 22, 2004

(30) Foreign Application Priority Data

Feb. 6, 2001 (NL) ..... 1017295

(51) Int. Cl.
*F01C 1/00* (2006.01)
*F03C 2/00* (2006.01)

(52) U.S. Cl. ..... 418/255; 418/152; 418/253; 222/134; 222/135

(58) Field of Classification Search ..... 418/255–257, 418/253, 254, 152; 222/134, 135
See application file for complete search history.

(56) References Cited

U.S. PATENT DOCUMENTS

| | | | | | |
|---|---|---|---|---|---|
| 1,952,834 | A | * | 3/1934 | Beidler et al. | 418/255 |
| 2,014,678 | A | * | 9/1935 | Zoller | 123/51 B |
| 2,260,888 | A | * | 10/1941 | Davis | 418/255 |
| 3,544,245 | A | * | 12/1970 | Mowbray | 418/258 |
| 4,622,717 | A | | 11/1986 | Bollinger | |
| 5,102,314 | A | * | 4/1992 | Staudenrausch | 418/255 |

FOREIGN PATENT DOCUMENTS

| | | | | |
|---|---|---|---|---|
| DE | 54 866 | C | | 1/1891 |
| EP | 339332 | A2 | * | 11/1989 |
| FR | 640 876 | A | | 7/1928 |
| JP | 59 168291 | A | | 9/1984 |
| WO | WO 98/22206 | A2 | | 5/1998 |

* cited by examiner

*Primary Examiner*—Theresa Trieu
(74) *Attorney, Agent, or Firm*—The Webb Law Firm

(57) ABSTRACT

A dividing device, comprising at least one vane-type rotor comprising a hub provided with continuous vanes which are slidable through the hub along their longitudinal axis and almost perpendicular to the axis of the hub, the hub being provided with axial grooves for holding the continuous vanes which grooves partially divide the hub in sections, a part of the sections being provided with an aperture axially through the hub, for providing a means for connecting several vane-type rotors to each other, the apertures being unround.

12 Claims, 4 Drawing Sheets

DIVIDING DEVICE

BACKGROUND OF THE INVENTION

1. Field of the Invention

The invention relates to a dividing device.

2. Description of the Related Art

It is common practice to supply a flow of material, preferably dough material or minced meat or stuffing for croquettes and the like, by means of a vacuum fill machine to a dividing device. As the vacuum fill machine is an expensive machine, it is preferred to provide the vacuum fill machine with a dividing device, in which the flow of material is first divided into several as identical as possible flows and which care subsequently, dependently or independently from each other, divided into portions. It is desirable that the size and weight of the portions are repeated as accurately as possible. In many production situations it is desirable to keep the standard deviation between the portions as small as possible.

From for instance WO-A2-98/22206 a dividing device is known provided with a device for converting one flow of material into several flows, in which the device has been provided with a vane-type rotor. A drawback of the embodiment described however is that very large standard deviation appeared to occur in the size of the flows and thus the portions, particular in case of viscous materials.

SUMMARY OF THE INVENTION

It is an object of the invention to overcome the drawbacks mentioned. To that end the invention relates to a dividing device, comprising at least one vane-type rotor comprising a hub provided with continuous vanes which are slidable through the hub along their longitudinal axis and almost perpendicular to the axis of the hub, the hub being provided with axial grooves for holding the continuous vanes such grooves partially divide the hub in sections, a part of the sections being provided with an aperture axially through the hub, for providing a means for connecting several vane-type rotors to each other, the apertures being unround It has appeared that by using unround apertures the standard deviation between the size of the portions could be reduced for a large part.

A further reduction in the standard deviation could be realised when the apertures at the inside comprised at least: one flat surface plane. Preferably the apertures have a polygonal cross-section, preferably square or triangular.

To reduce wear and tear and to further reduce standard deviation. It is preferred that the hub is provided with a metal hood at the side opposite the grooves. In most embodiments the hub will be made of synthetic material, such as for instance nylon. The slidable vanes will then for instance be made of stainless steel. In most case the metal hood is made of stainless steel as well, in connection with the corrosion and the requirements in the food industry.

In a preferred embodiment the vane-type rotor is provided with six vanes, the vanes preferably being built from three continuous vane elements which are slidable in the hub in the grooves perpendicular to the longitudinal axis of the hub.

An embodiment for realising the slidable vanes regards one in which two vane elements in the centre are provided with a recess on at least one longitudinal side and the third vane element is provided with recesses on both longitudinal sides, the addition sum of the depths of the recesses being at least equal to the width of a vane element.

Preferably the smallest width of the recesses is equal to the minimal protrusion of the vanes.

Preferably the largest width of the recesses is smaller or equal to the radius of the hub increased by the thickness of the vane elements.

Additionally the invention relates to a dividing device provided with at least one inlet and at least two outlets and a housing provided with a chamber connected to the inlets and the outlets, and in which at least two vane-type rotors, have been rotatably arranged, the vane-type rotors being provided with axial, unround apertures for connecting the vane-type rotors one to the other by means of connectors so-that the vane-type rotors form one rotatable unity.

In such a dividing device particularly the vane-type rotors are preferably provided with vane elements running through the hub which elements are slidable longitudinally a long their axis and perpendicular to the axis of the hub through the hub.

Additionally the invention relates to a dividing device provided with at least one inlet and at least two outlets and a housing provided with a chamber connected to the inlet or inlets and to the outlets, and in which at least one vane-type rotor has-been rotatably arranged, the vane-type rotor being provided with a synthetic hub and vane elements running through the synthetic hub which elements are slidable longitudinally along their axis and perpendicular to the axis of the synthetic hub, the synthetic hub being provided with a metal hood.

In particular the hub is provided with axial grooves that partly divide the hub into sections, and the hub is provided with the metal hood at the side opposite the side provided with the grooves.

Additionally the, invention relates to a vane-type rotor, suitable for a device as described above in the text.

Said aspects of the invention can be combined if so desired.

BRIEF DESCRIPTION OF THE DRAWINGS

The invention will be further elucidated on the basis of an exemplary embodiment of a dividing device according to the invention, in which.

DETAILED DESCRIPTION OF THE INVENTION

Figure 1:
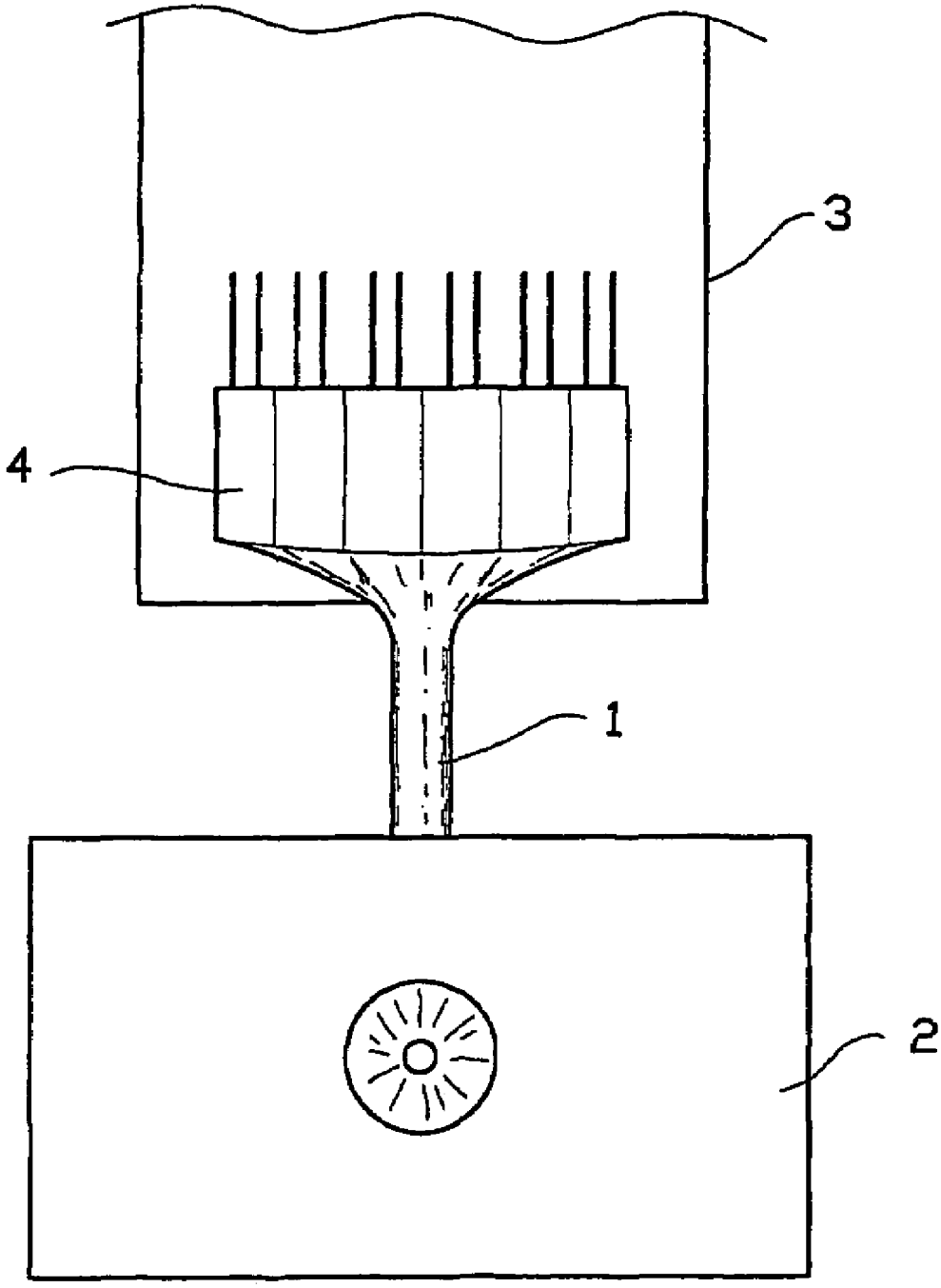
FIG. 1 shows a dividing device according to the invention.

FIG. 1 shows a device for processing among other meat dough, provided with a dividing device 1 according to the invention, a vacuum fill machine 2, connected to an inlet opening of the dividing device 1 and a discharge device 3 for discharge of the various flows of material coming out of the outlet openings of the dividing device 1. The dividing device 1 is provided with various segments 4.

Figure 2:
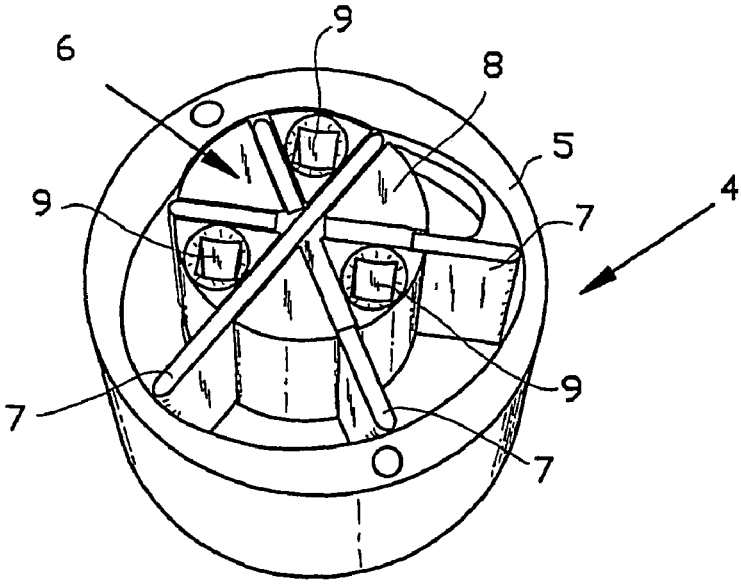
FIG. 2 shows a segment of the housing including vane-type rotor.

FIG. 2 shows a segment 4 of the dividing device 1 as can be seen in FIG. 1. Each segment, is provided with a housing 5 in which a vane-type rotor 6. The vane-type rotor 6 is provided with vanes 7 that are movable in a hub 8, longitudinally with respect to the axis of rotation of the vane-type rotor. The hub is provided with unround apertures 9. The hub is divided into sections 10 by axial grooves. Generally the hub is made of a synthetic material such as nylon.

Figure 3:
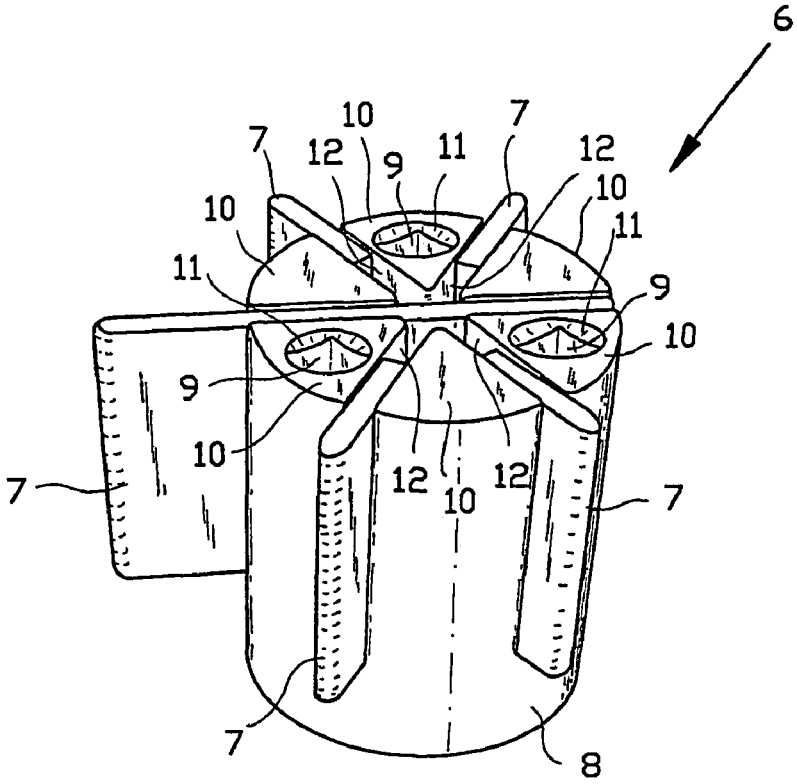
FIG. 3 shows a vane-type rotor according to one aspect of the invention.

FIG. 3 shows the vane-type rotor 6 according to the invention in detail. In the figure it can clearly be seen that the vane-type rotor 6 comprises a hub 8 provided with axial grooves 12 that partially divide the hub into sections 10. A part of those sections 10 is here provided with unround apertures 9 that have been provided with a flat surface plane 11. In this exemplary embodiment the apertures are square. The vanes 7 can move longitudinally in the axial grooves. Generally the vanes are made of metal, preferably stainless steel.

Figure 4:
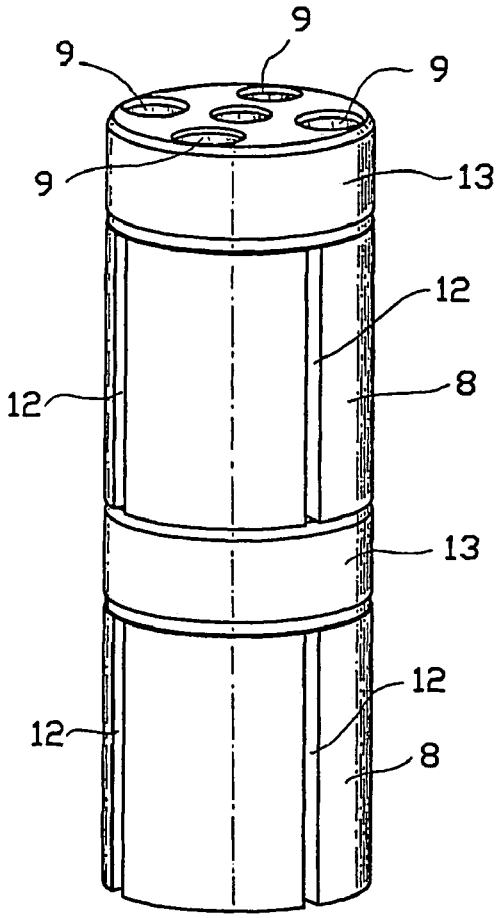
FIG. 4 shows two connected hubs.

FIG. 4 shows how various hubs 8 of the dividing device 1 can be placed onto each other for forming one continuous hub. Here connection elements, such as bolts or pins, are inserted through the apertures 9, for connecting the various hubs one to the other. The shape of the bolts is adjusted here to the cross-section of the apertures. Preferably the connections elements exactly fit in the apertures.

Figure 5:
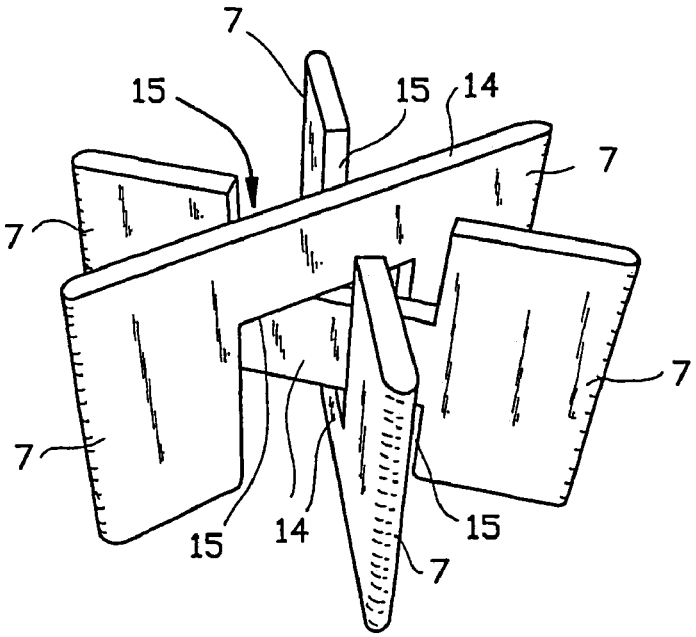
FIG. 5 shows vane elements according to an aspect of the invention.

FIG. 5 shows the vanes 7 of the vane-type rotor 6 according to the invention. It can clearly be seen that the vanes 7 consist of continuous vane elements 14 that have been provided with recesses 15, that, are arranged in the continuous vane elements 14 in such a way that the vanes can slide longitudinally, that means perpendicular to the axis of rotation of the vane-type rotor. In the figure three vane elements are shown but two vane elements forming four vanes can also be used.

Figure 6:
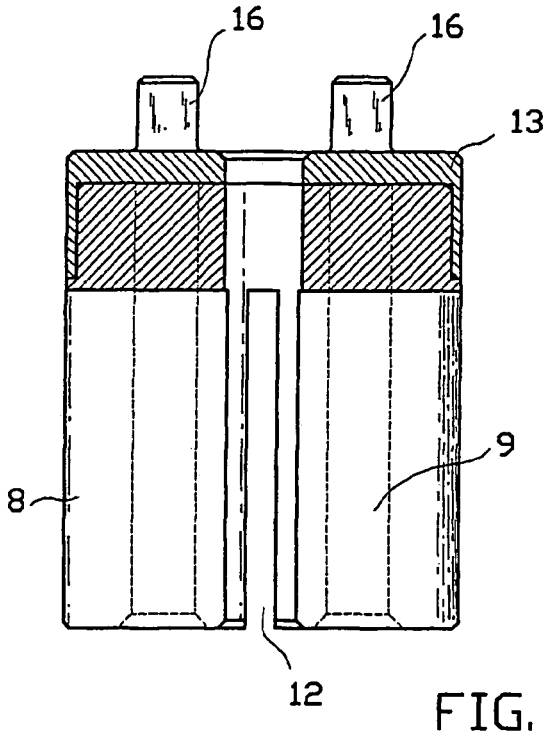
FIG. 6 shows a longitudinal section of a hub according to the invention.

FIG. 6 shows the hub 8 of a vane-type rotor 6 according to the invention. The grooves 12 can clearly be seen here and continuous unround apertures 9 indicated by dots. The hub 8 here is provided with a metal hood 13 according to a special embodiment of the invention, which hood 13 in this embodiment is provided with pin-shaped protrusions which correspond to the unround apertures for the connection in a mutual engaging manner of the vane-type rotor of the several vane-type rotors of the various segments. It should be clear that the unround apertures 9 need not run through the entire hub 8. An advantage of this is a simpler assembling and disassembling, among others for cleaning, and no separate extra parts.

Figure 7:
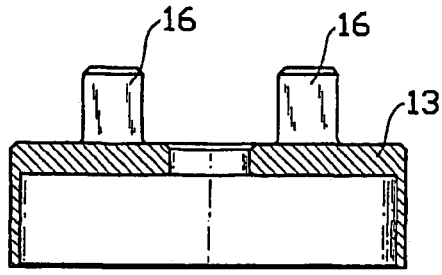
FIG. 7 shows a cross-section of the metal hood 6 of the hub according to an aspect of the invention.

FIG. 7 shows a cross-section of the metal hood 13 provided with the pin-shaped protrusions 16.

Figure 8:
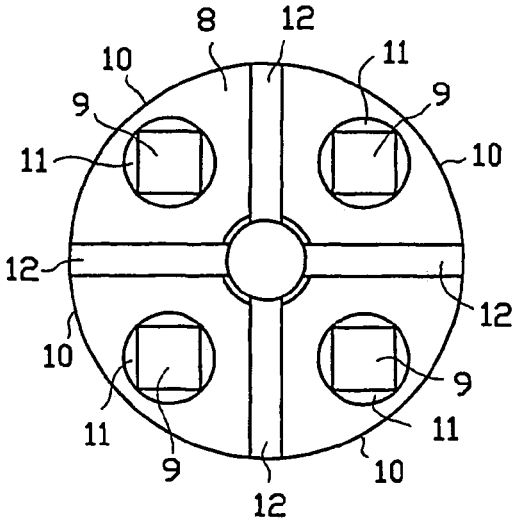
FIG. 8 shows a bottom view of a hub according to the invention.

FIG. 8 shows a bottom view of the hub 8 of a vane-type rotor 6 according to the invention. The axial grooves 12 can clearly be seen as well as the apertures 9 provided with the flat surface planes 11, in this case square apertures. The axial grooves 12 divide the hub 8 into sections 10. The grooves do not entirely run lengthwise through the hub. As can also be seen, in FIG. 6. In this example all sections have been provided with apertures for providing large torsion rigidity.

Figure 9:
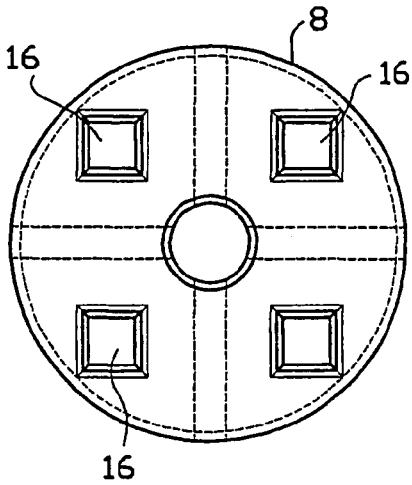
FIG. 9 shows a top view of a hub according to the invention at the side of the metal hood.

FIG. 9 shows a top view of the, metal hood 13 of FIG. 7. The synthetic hub 8 with the axial grooves 12 is indicated by dots. In this figure it can clearly be seen that the pin-shaped protrusions 16 have a square shape and as a result correspond to the square apertures 9 as indicated in the bottoms view of FIG. 8.

The operation of the dividing device is as follows. A fill machine guides dough material via at least one inlet opening into the dividing device. As a result of the often high pressure, up to over 50 bar, the flow of dough sets the vane-type rotor in motion and the vane-type rotors start rotating. As a result a constant flow of dough is ensured.

When rotating the vane-type rotors the vane elements move longitudinally and a vane will at some moment during a revolution be entirely accommodated in the hub, and during a later moment protrude maximally out of the hub.

The invention claimed is:

1. A dividing device, comprising at least one vane-type rotor comprising a hub provided with continuous vanes which are slidable through the hub along their longitudinal axis and almost perpendicular to the axis of the hub, the hub being provided with axial grooves for holding the continuous vanes, which grooves partially divide the hub in sections, a part of the sections being provided with an aperture axially through the hub for providing a means for connecting several vane-type rotors to each other, the apertures being unround, wherein at least one connection element is engageable through the apertures, the cross-section of the connection element being substantially identical to the shape of the apertures.

2. The dividing device according to claim 1, wherein the apertures at the inside comprise at least one flat surface plane.

3. The dividing device according to claim 1, wherein the apertures have a polygonal cross-section.

4. The dividing device according to claim 1, wherein the hub is provided with a metal hood at the side opposite the grooves.

5. The dividing device according to claim 1, wherein the vane-type rotor is provided with six vanes.

6. The dividing device according to claim 5, wherein the vanes are built from three continuous vane elements which are slidable in the hub in the grooves perpendicular to the longitudinal axis of the hub.

7. The dividing device according to claim 6, wherein two vane elements in the centre thereof are provided with a recess on at least one longitudinal side and a third vane element is provided with recesses on both longitudinal sides, with the addition sum of the depth of the recesses at least equal to the width of a vane element.

8. The dividing device according to claim 7, wherein the smallest width of the recesses is equal to the minimal protrusion of the vanes.

9. The dividing device according to claim 7, wherein the largest width of the recesses is smaller or equal to the radius of the hub increased by the thickness of the vane elements.

10. A dividing device comprising at least one inlet and at least two outlets and a housing provided with a chamber connected to the inlets and the outlets, and with at least two vane-type rotors rotatably arranged thereon, with the vane-type rotors provided with axial, unround apertures for connecting the vane-type rotors one to the others by connectors or connection elements, which have a cross-section substantially identical to the shape of the apertures, so that the vane-type rotors form one rotatable unity.

11. The dividing device according to claim 10, wherein the vane-type rotors are provided with vane elements running through the hub, which elements are slidable longitudinally along their axis and perpendicular to the axis of the hub through the hub.

12. A dividing device comprising at least one inlet and at least two outlets and a housing provided with a chamber connected to the inlet or inlets and to outlets, and with at least one vane-type rotor rotatably arranged thereon, with the vane-type rotor provided with a synthetic hub and vane elements running through the synthetic hub, which elements are slidable longitudinally along their axis and perpendicular to the axis of the synthetic hub, and with the synthetic hub provided with a metal hood, wherein the vane-type rotor is provided with at least one axial, unround aperture for connection to other rotors by connectors or connection elements, which have a cross-section substantially identical to the shape of the aperture.

* * * * *

UNITED STATES PATENT AND TRADEMARK OFFICE

CERTIFICATE OF CORRECTION

PATENT NO. : 7,037,093 B2
APPLICATION NO. : 10/475947
DATED : May 2, 2006
INVENTOR(S) : De Jong It is certified that error appears in the above-identified patent and that said Letters Patent is hereby corrected as shown below:

On Title Page, col. 1, See Item (12), under "United States Patent", the inventor shown as "Jong" should be shown as -- De Jong --

On Title Page, col. 2, See Item (56) References Cited,
U.S. PATENT DOCUMENTS, the following patent should be listed:

-- 5,906,297 A * 5/1999 Cole .....222/134 --

Signed and Sealed this

Twenty-fourth Day of October, 2006

JON W. DUDAS
*Director of the United States Patent and Trademark Office*